US006044991A

United States Patent [19]

Freudenthal et al.

[11] Patent Number: 6,044,991

[45] **Date of Patent: *Apr. 4, 2000**

[54] LOAD MEASURING APPARATUS FOR AERIAL BOOMS AND JIBS

[75] Inventors: Frank D. Freudenthal; Edwin L. Vollmer, both of St. Joseph, Mo.

[73] Assignee: Altec Industries, Inc., Birmington, Ala.

[ * ] Notice: Under 35 U.S.C. 154(b), the term of this patent shall be extended for 370 days.

[21] Appl. No.: 08/492,590

[22] Filed: Jun. 21, 1995

[51] Int. Cl.[7] ..... B66C 13/16

[52] U.S. Cl. ..... 212/278; 73/862.56; 212/283

[58] Field of Search ..... 212/278, 283; 73/862.56, 862.631; 340/685

[56] References Cited

U.S. PATENT DOCUMENTS

| | | | |
|---|---|---|---|
| 3,278,925 | 10/1966 | Saunders et al. . | |
| 3,330,154 | 7/1967 | Habern et al. | 73/862.631 |
| 3,826,321 | 7/1974 | Rigney et al. | 340/685 |
| 4,003,482 | 1/1977 | Cheze . | |
| 4,098,410 | 7/1978 | Nixon et al. . | |
| 4,566,341 | 1/1986 | Kovacs | 73/862.56 |
| 4,582,206 | 4/1986 | Johnson . | |
| 4,746,024 | 5/1988 | Hensler . | |

FOREIGN PATENT DOCUMENTS

| | | | |
|---|---|---|---|
| 1067230 | 10/1959 | Denmark | 73/862.56 |
| 6-117123 | 9/1981 | Japan | 212/283 |

OTHER PUBLICATIONS

Metrox "Crane Load Monitors", pp. 36–37.

Metrox "Typical Applications", p. 2.

Metrox "Special Requirements & Instrumentation", p. 9.

*Primary Examiner*—Thomas J. Brahan

*Attorney, Agent, or Firm*—Shook, Hardy & Bacon LLP

[57] ABSTRACT

A load measuring device for an aerial machine having a boom or jib which handles loads. A load bearing sheave has a winch line passed over it to raise and lower the load. A guide sheave maintains the winch line at a constant entry angle to the load bearing sheave. A dual axis load pin on which the load bearing sheave is mounted measures the force components of the load along two mutually perpendicular axes. Because the entry angle is constant, the load is dependent only on the two measurable force components and can be calculated and displayed. An overcenter machine has two load bearing sheave which are used alternately depending on whether the machine is overcenter or not. Each sheave in this case is mounted on a dual axis load pin.

19 Claims, 2 Drawing Sheets

LOAD MEASURING APPARATUS FOR AERIAL BOOMS AND JIBS

FIELD OF THE INVENTION

This invention relates generally to machines having aerial booms, including digger derricks, cranes and material handling aerial devices. More particularly, the invention deals with a device for determining and displaying the magnitude of the load which is handled by the boom or jib of the machine.

BACKGROUND OF THE INVENTION

Aerial booms are used on a variety of machines which operate to raise and lower heavy loads. Examples include cranes, digger derrick machines and aerial devices which have materials handling capability. By way of example, a vehicle mounted aerial device typically includes a boom which can rotate and pivot up and down. The boom assembly normally includes a lower boom mounted to the vehicle and an upper boom which articulates relative to the lower boom. The tip of the upper boom carries a working platform which may be a bucket or basket from which workers can perform various jobs. It is common for this type of aerial device to be used in materials handling applications involving the raising and lowering of heavy loads. Materials handling is usually carried out by a pivotal jib on the tip of the upper boom and a winch having a line passing over a sheave on the tip of the jib. Electrical transformers and other heavy loads can be raised and lowered on the winch line.

Aerial machines have maximum load ratings that limit the loads that can be lifted at each different boom position. Industry regulations and general safety considerations require that the maximum load rating not be exceeded. Consequently, it is important for the machine operator to know the weight of the load so that he can make certain that he is operating safely within the rated capacity of the machine.

The loads which are handled by aerial devices, cranes and digger derricks can be measured in various ways. The prevalent technique in the past has involved the installation of a tensiometer or similar device to measure the tension in the winch line. Examples of machines which use tensiometers are disclosed in U.S. Pat. No. 3,278,925 to Saunders et al., U.S. Pat. No. 4,003,482 to Cheze, U.S. Pat. No. 4,098,410 to Nixon et al. and U.S. Pat. No. 4,746,024 to Hensler. As exemplified by these patents, the tensiometer is constructed with three sheaves or rollers, two of which maintain the line at a constant wrap angle on the third sheave or roller (the wrap angle being the angular arc along which the line contacts the third sheave or roller). The force component in a selected direction applied to the third sheave or roller is measured by any of a variety of suitable devices. With a constant wrap angle, the line tension can be calculated from the measured force which is applied to the measurement sheave or roller.

Although tensiometers applied in this fashion can provide accurate load measurements, they are not without problems. They require three sheaves or rollers and are thus somewhat complicated mechanically. It is also necessary to provide the tensiometer as a separate component which must be added to the machine and have the winch line threaded through it. Thus, the expense and complexity of the machine are increased, as are maintenance and reliability problems.

One type of commercially available device that can be used to measure a load in a given direction or two mutually perpendicular directions is a load pin. A load pin includes one or more strain gauges which provide electrical output signals proportional to the strain they sense. A dual axis load pin is useful in a situation where the wrap angle varies, so long as either the entry angle or exit angle of the line is constant. However, even a dual axis load pin is unable to measure a load if both the entry angle and the exit angle vary, as is the case with a load bearing sheave on a aerial boom or jib. In this context, the entry angle is the angle of the part of the line extending from the winch to the sheave relative to another axis (such as the longitudinal axis of the jib or boom). The exit angle is the angle of the part of the line extending from the load to the sheave relative to the other axis.

As the boom or jib angle varies from horizontal, the exit angle of the line from the sheave also varies. The entry angle of the winch line varies somewhat with changes in the boom or jib angle. Sometimes, the winch is mounted on the boom so that when the jib is articulated relative to the boom, the entry angle can change significantly. Even if the winch is mounted on the jib, the entry angle can still change. One reason is that the jib deflects to varying degrees when it is handling different loads. Also, the winch line approaches the sheave at a different angle when it is fully wound on the winch drum than in a case where it is fully or nearly fully unwound from the drum.

The situation is even more complicated with an overcenter machine which is one where the boom or jib can move past a vertical position. An overcenter machine is equipped with two load bearing sheaves which are used alternately when the aerial boom or jib is on opposite sides of vertical. In this case, it must be taken into account that either sheave can be loaded when the machine is operating and that the load handled by the boom or jib can apply moments in opposite directions when the structuL,e is on opposite sides of vertical.

SUMMARY OF THE INVENTION

The present invention is directed to an improved load measuring device for an aerial boom or jib. The invention is particularly characterized in that it makes use of the load bearing sheave that is already present on the machine in order to measure the load that the machine is handling. Consequently, there is no need to provide a separate complicated instrument such as a tensiometer of the type commonly used in the past.

A key feature of the invention which enables the load to be accurately measured is the provision of a guide element which maintains the entry angle of the winch line to the sheave constant relative to the boom or jib axis. This allows a dual axis load pin to be used to mount the sheave and to also sense the force components along two perpendicular axes. Even though the exit angle of the line varies, holding the entry angle constant allows the load pin or other bi-axial load transducer to provide enough information that the load can be calculated by a microprocessor or other computational device.

The guide element also allows the load to be accurately measured on an overcenter machine. In this case, two dual axis load pins can be used, one for each sheave on the boom or jib tip. If the entry portion of the winch line is held parallel to the boom axis (or at another fixed angle), the entry angle for each sheave is constant. Therefore, regardless of which sheave is in use at the time, the load pin provides sufficient information to accurately calculate the load.

Preferably, the information that is measured by the load pin or other transducer is applied to a microprocessor programmed to perform the necessary computations and provide output signals used to display the load on a suitable display device. The display may be located at the boom or jib tip where it is easily read by workers in the bucket of an aerial device. Alternatively, the display can be located at an operator's station on the ground in the case of a digger derrick or crane, with the signals being suitably transmitted from the boom tip to the display device.

Because of its novel construction, the present invention provides a load measuring device that is smaller, lighter, more accurate and easier to read than prior load meas.iring systems.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
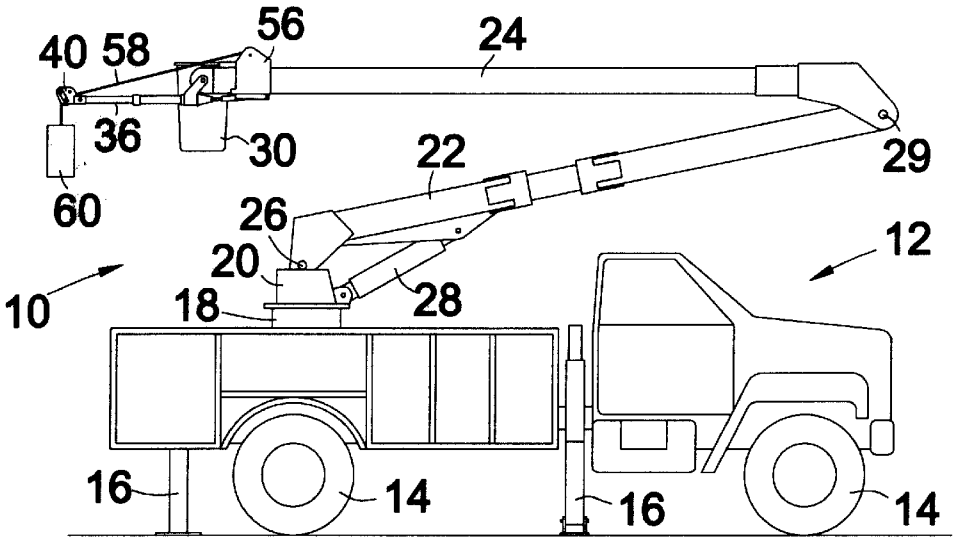
FIG. 1 is a side elevational view of an aerial machine having an articulating boom and a jib equipped with a load measuring device constructed according to a preferred embodiment of the present invention.

Referring now to the drawings in more detail and initially to FIG. 1, numeral 10 generally designates a vehicle mounted aerial device of the type to which the load measuring system of the present invention may be applied. The aerial device 10 is mounted on a vehicle 12 having wheels 14 and provided with outriggers 16 that enhance the stability of the vehicle when the aerial device is in o peration.

The aerial device 10 is mounted on a pedestal 18 carried in the bed of the vehicle 12. A turntable 20 is mounted for rotation on the pedestal 18 about a vertical axis and is rotated by a suitable drive mechanism (not shown). Mounted on the turntable 20 is a boom assembly which includes a lower boom 22 and an upper boom 24.

The lower boom 22 is connected with turntable 20 for up and down pivotal movement about a horizontal pin 26. A hydraulic lift cylinder 28 is connected at its base end with the turntable 20 and at its rod end with the boom 22 in order to pivot the boom up and down about the pin 26. The upper boom 24 is connected to the end of the lower boom 22 for articulating movement about a horizontal pin 29. A hydraulic cylinder and associated link mechanism (not shown) are used to articulate the upper boom 24 about the pivot pin 29.

Figure 2:
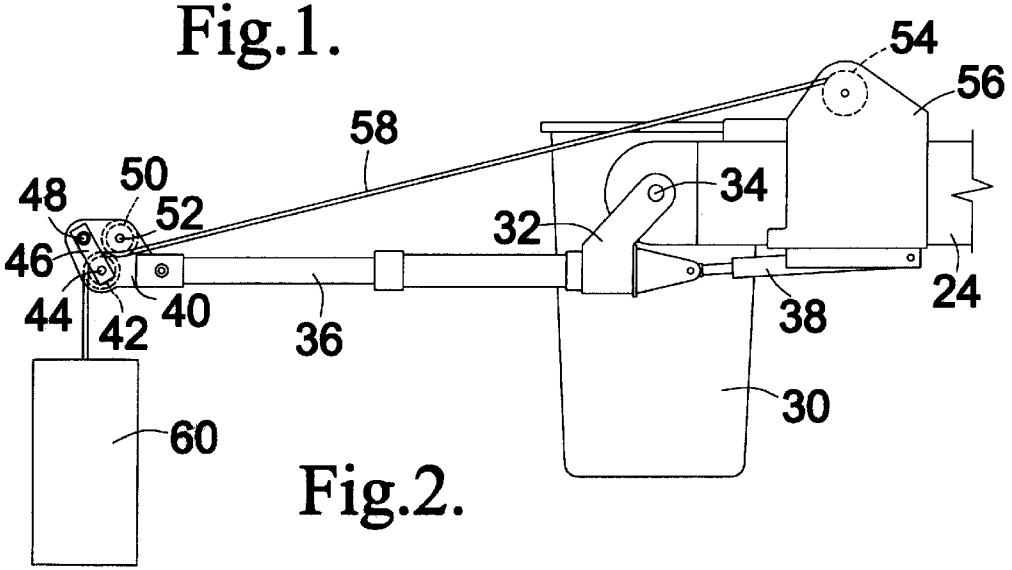
FIG. 2 is a fragmentary side elevational view on an enlarged scale of the tip portion of the boom shown in FIG. 1 along with the components carried thereon.
Figure 3:
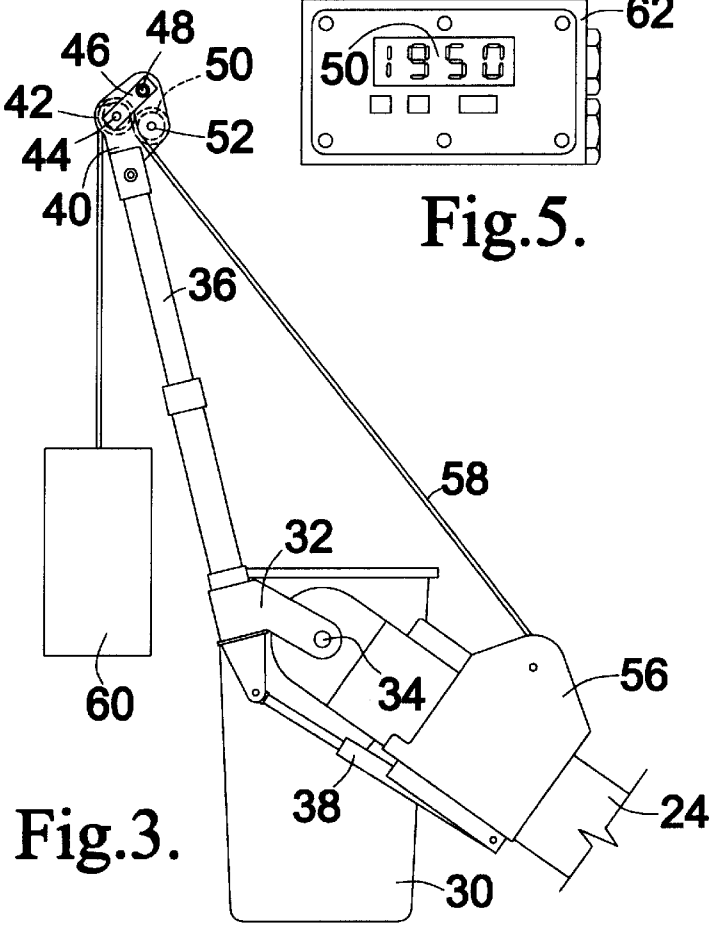
FIG. 3 is a fragmentary elevational view similar to FIG. 2 but showing the boom and jib angled upwardly to raise the load that is handled by the machine.

With additional reference to FIGS. 2 and 3, the upper boom 24 has a tip carrying one or more work platforms which may take the form of a single bucket 30 located to one side of the boom tip. One or more workers may be stationed in the bucket 30 in order to perform various jobs. The bucket 30 can pivot about a horizontal platform pin (not shown) so that its floor remains horizontal at all angular positions of the boom. A jib bracket 32 is mounted on the boom tip for pivotal movement about a horizontal pin 34 which may be coincident with the platform pin. A jib 36 extends outwardly from the bracket 32. The jib 36 is pivoted about pin 34 by a cylinder 38 having its rod end connected with the bracket 32 and its base end connected with the tip area of the upper boom 24.

A mounting bracket 40 is secured to the free end of the jib 36. A load bearing sheave 42 is mounted on the bracket 40 for rotation about a load pin 44 which is fixed to the bracket 40. The load pin 44 has a horizontal orientation and will be described in more detail. The load pin 44 connects with a plate 46, as does a second load pin 48. The second load pin 48 is also secured to the mounting bracket 40 and serves to maintain the load pin 44 in a fixed position in the embodiment shown in FIGS. 1–3. In this embodiment, the second load pin 48 does not function to measure loads and may be replaced by a stub pin if desired.

A guide element or means in the form of a sheave 50 is also mounted on the mounting bracket 40. The sheave 50 is an idler which can turn freely about a horizontal pin 52 mounted to the bracket 40. Sheave 50 is preferably located close to but offset from the load bearing sheave 42. When the jib 36 is in the horizontal position shown in FIG. 2, sheave 50 is located slightly above and inboard from sheave 42.

The tip of boom 24 is equipped with a power driven winch having a rotatable winch drum 54. The winch drum 54 is mounted for rotation on a bracket 56 which is secured to the tip portion of boom 24. A winch cable 58 is wound around the drum 54 and is threaded between the two sheaves 42 and 50. The bottom portion of the guide sheave 50 contacts the winch cable 58, while the cable is drawn over the load bearing sheave 42. The free end of the winch cable 58 is provided with suitable equipment (not shown) that allows it to be hooked or otherwise secured to a load 60 in order to raise and lower the load as the winch cable is wound in and paid out. The guide sheave 50 is located such that the portion of the winch cable 58 which extends from sheave 50 to sheave 42 is maintained in a fixed orientation. In this embodiment, such portion of the winch cable is parallel to the longitudinal axis of the jib 36, although it need not be.

Figure 5:
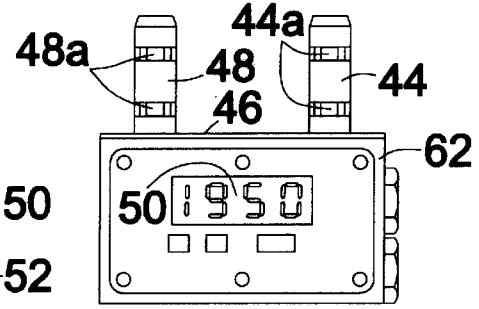
FIG. 5 is a front elevational view of a display that is used to visually display the load that is measured in accordance with a preferred embodiment of the present invention.

FIG. 5 discloses a display device which is used to provide a visual display of the load that is measured by the load measuring arrangement of the present invention. The load pin 44 and pin 48 which may be a load pin or simply a stub pin extend through the plate 46 and into an enclosure 62 of which plate 46 is a part. A conventional microprocessor (not shown) is housed within the enclosure 62 and receives the electrical signals from the load pins 44 and 48 (although load pin 48 is not used to provide a signal in the embodiment shown in FIGS. 1–3). The load pins 44 and 48 are conventional dual axis load pins having pairs of strain gauges 44*a* and 48*a* which may be located in circumferential grooves in the pins or otherwise mounted on the load pins. The strain gauges provide electrical signals proportional to the strain to which they are subjected in two mutually perpendicular directions. These electrical signals are applied as input signals to the microprocessor which is programmed in a manner to be described in more detail to calculate the magnitude of the load 60 based on the input information provided by the load pins. The microprocessor provides output signals that are used to generate a display on a screen 64 on the face of the enclosure 62. The display is preferably a digital display which indicates the magnitude of the load 60 in pounds or whatever other units are desired. The display may be a seven segment digital readout, an analog display or any other suitable type. The strain gauges are preferably oriented such that they measure the load in directions parallel and perpendicular to the longitudinal axis of the jib.

Figures 4, 6, 7, 8:
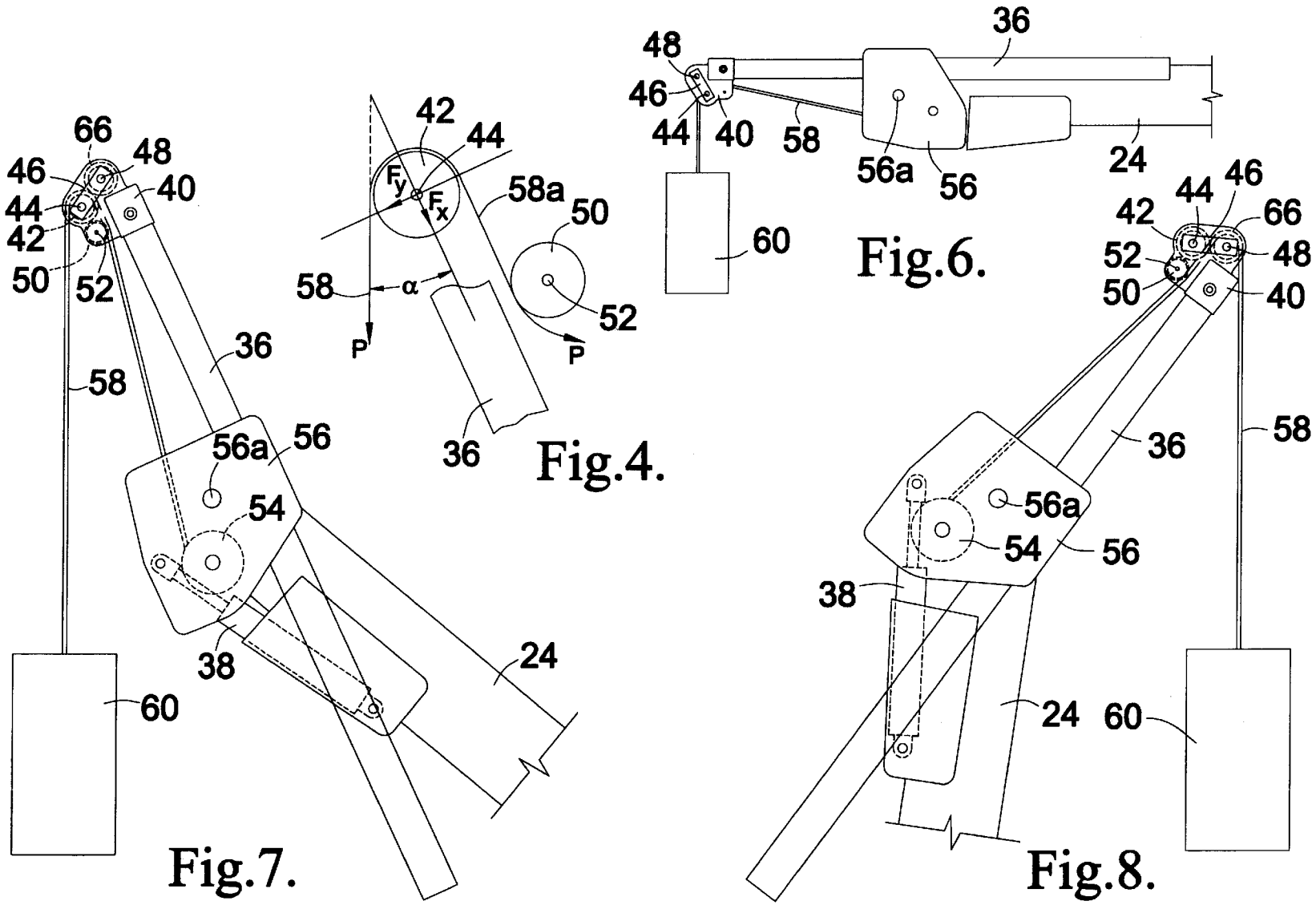
FIG. 4 is a diagrammatic view of the tip portion of the jib illustrating the jib tip geometry and the forces that are applied to the load bearing sheave during handling of the load.
FIG. 6 is a fragmentary side elevational view showing the tip portion of an overcenter type boom equipped with a load measuring device constructed in accordance with the present invention.
FIG. 7 is a fragmentary elevational view similar to FIG. 6 but on an enlarged scale and with the boom and jib angled upwardly to raise the load that is being handled by the machine.
FIG. 8 is a fragme ntary side elevational view similar to FIG. 7 but showing the boom and jib moved to an overcenter position in which the winch line is transferred to a second load bearing sheave on the jib tip.

FIG. 4 shows diagrammatically the geometry of the tip portion of the jib 36 and illustrates how the information from the load pin 44 is used to calculate the magnitude of the load (identified as P in FIG. 4). In the illustrated embodiment, the load pin 44 is oriented such that one of its axes lies along the x axis shown in FIG. 4 which is coincident with the longitudinal axis of the jib 36. The other axis of the load pin 44 is the y axis depicted in FIG. 4, and it is perpendicular to the x axis and to the longitudinal axis of the jib 36 in the illustrated embodiment. The angle a illustrated in FIG. 4 is the angle between the x axis and the portion of the winch cable 58 which extends between the load 60 and the load bearing sheave 42. The guide sheave 50 is located such that regardless of the angle at which the winch cable 58 approaches sheave 50, the portion of the cable that extends from the sheave 50 to sheave 42 (identified as the cable portion 58*a* in FIG. 4) is, in the illustrated embodiment, maintained parallel to the longitudinal axis of the jib 36 (the x axis) at all times and at all angular orientations of the jib 36. Thus, while the exit angle α varies according to the jib orientation, the entry angle to the sheave 42 is always fixed at 0° regardless of the jib orientation. A different fixed orientation of the exit angle is also possible.

From the geometry depicted in FIG. 4, it is evident that the following mathematical relationships apply:

$$F_x = P + P\cos\alpha = P(1+\cos\alpha) \quad \text{[Equation 1]}$$

$$F_y = P\sin\alpha \quad \text{[Equation 2]},$$

where $F_x$ is the component of the load P in the x direction and $F_y$ is the component of the load P in the y direction. Thus, $$\frac{F_y}{F_x} = \frac{P\sin\alpha}{P(1+\cos\alpha)} = \frac{\sin\alpha}{1+\cos\alpha} = \tan\frac{\alpha}{2}$$

and, $$\alpha = 2\arctan F_y/F_x.$$

Solving equation 2 for P:

$$P = \frac{F_y}{\sin\alpha} = \frac{F_y}{\sin(2\arctan F_y/F_x)}$$

From this solution, the magnitude P of the load 60 can be calculated if the quantities $F_y$ and $F_x$ are known. The load pin 44 is orientated to measure these quantities $F_x$ and $F_y$, and it thus provides sufficient information to enable the microprocessor to calculate the quantity P and display it on the screen 64. It is noted that the display screen 64 is located on the tip portion of the jib 36 where it is close to the workers stationed in the bucket 30. The workers in the bucket normally control the lifting of the load 60, and they are thus provided with the load information that allows them to operate the machine within its rated load capacity.

As an alternative, the display screen 64 can be located at an operator station on the ground in the vicinity of the bed of the vehicle 12. In the case of digger derrick machines which are normally operated from a control station at this location, the display is preferably located near the operator. The signals provided by the load pin 44 can be transmitted to the ground in a suitable manner such as by hard wiring or fiber optic cables or radio signals. Alternatively, the calculations can be performed at the boom tip location and transmitted to the operator station near the ground.

It is noted that other equating can be derived from the geometric relationships that are involved. In particular, it is possible to derive equations that do not include trigonometric functions in order to simplify the software for the microprocessor. An example is $$P = \frac{F_y^2 + F_x^2}{2F_x}$$

FIGS. 6–8 show the tip portion of the boom and related components of an overcenter aerial device which is a machine having the capability of the upper boom 24 moving past a vertical position. The general construction of an overcenter machine is similar to that of the non-overcenter machine shown in FIG. 2, and the components in FIGS. 6–8 which are similar to those of FIGS. 1–3 are designated by the same reference numerals.

In the arrangement of FIGS. 6–8, the winch drum 54 and jib pole 36 are mounted on the same bracket 56 which pivots on the tip of boom 24 about a horizontal axis 56a. A hydraulic cylinder 38 connects with the tip portion of boom 24 at its base end and with the bracket 56 at its rod end in order to pivot the bracket 56 and thus vary the angulation of the jib pole 36.

In the overcenter machine shown in FIGS. 6–8, the bracket 40 on the end of the jib 36 is provided with the load bearing sheave 42 which is mounted to turn on the load pin 44 and with the guide sheave 50 which is mounted to turn on pin 52. In addition, another load bearing sheave 66 is mounted on the bracket 40. Sheave 66 rotates on the second load pin 48 that is used when the machine is operating in the overcenter position shown in FIG. 8. The two sheaves 42 and 66 are adjacent to one another so that the winch line 58 passes between them.

When the machine is operating in the non-overcenter position shown in FIG. 7, the winch line 58 passes over sheave 42 which thus bears the weight of the load 60. When the machine operates in the over-center position shown in FIG. 8, the winch line 58 passes over the other sheave 66 which then bears the weight of the load 60. The guide sheave 50 is located such that the winch line 58 is maintained parallel to the longitudinal axis of the jib 36 in the portion of the winch line which extends from the guide sheave 50 to whichever of the sheaves 42 or 66 is bearing the weight of the load 60 at the time. Consequently, load pin 44 measures the force components of the load 60 in the x and y directions in the non-overcenter position, while the other load pin 48 measures the load components in the x and y directions in the overcenter position of the machine. The mathematical relationships of FIG. 4 are the same in the overcenter position, and the microprocessor can be programmed to receive the input from whichever of the load pins 44 or 48 is loaded at the time and perform the calculations necessary to compute the magnitude of the load 60 and display it on the display screen 64.

Although it is convenient to use either one or two load pins to measure the force components of the load in two mutually perpendicular directions (one load pin for a non-overcenter machine and two load pins for an overcenter machine), other types of load measuring devices can be used. For example, strain gauges applied to the tip portion of the jib 36 can measure the force components, as can other devices such as power cylinders arranged so that the pressures they produce are proportional to the force components in the selected directions. It is also noted that the load measuring device of the present invention can be used on a crane or digger derrick machine in which there is a load bearing sheave mounted on the tip of the boom rather than on the tip of a jib pole.

While it is convenient for calculation simplicity to maintain the winch line portion 58*a* parallel to the x axis, it can be maintained at some other known angular orientation so long as it is constant. It is also convenient for the x axis to be parallel with the longitudinal axis of the jib or boom. However, the x and y axes can be at other orientations so long as their angular position is known relative to the axis of the jib.

Because of the presence of the guide sheave 50 which maintains a constant entry angle to the load bearing sheave 42 (or 66), the mathematical relationships previously described allow for a solution of the load P in terms of the force components $F_x$ and $F_y$ which can be measured by load pins or other devices. Without the guide sheave 50, the entry angle provides an additional unknown quantity which results in the presence of too many unknowns for the derivation of an equation that can be solved to provide the load. Thus, the guide sheave 50 is necessary in order to provide the geometry that is required for the magnitude of the load to be determined. Although the guide element that performs this function has been illustrated and described as a sheave, it can take a number of different forms, including a roller, a guide block, a slide pad or other means that is effective to maintain a constant entry angle to the load bearing sheave.

A conventional microprocessor is the preferred means for performing the calculations necessary to determine the magnitude of the load in accordance with the equation given previously. However, another type of calculation device can be used if desired. The display screen 64 is preferably located adjacent to the jib tip where it is easily visible to workers in the bucket 30. In the case of a digger derrick or crane where there is no personnel platform in the boom tip area, the display screen is preferably located near ground level at the station of the operator of the machine. In this case, the electrical signals from the load pin or pins can be transmitted to the ground station by any suitable means such as hard wiring. However, the boom tip often must be electrically insulated from the chassis of the vehicle which carries the boom, so it may be necessary to transmit the signals by fiber optic cables, radio waves or some other way that maintains the electrical isolation of the boom tip area.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described the invention, we claim:

1. An aerial apparatus which includes an angularly variable aerial structure which presents a longitudinal axis and terminates in a tip portion, means for varying the angle of said longitudinal axis relative to a horizontal orientation. a sheave on said tip portion, a winch, and a winch line passing over the sheave and operated by the winch to raise and lower a load carried on the winch line, wherein the improvement comprises:

means for measuring, in two mutually perpendicular directions which are fixed relative to said longitudinal axis, the components of the force applied to said sheave by the load;

winch line guide means for maintaining a portion of the winch line adjacent to the sheave at a known orientation relative to said longitudinal axis;

means for calculating from said force components the magnitude of the load; and means for providing an indication of the magnitude of the load.

2. The apparatus of claim 1, wherein said means for providing an indication comprises a screen and means for displaying on said screen the magnitude of the load.

3. The apparatus of claim 1, wherein said means for measuring comprises a dual axis load pin on which said sheave is mounted for rotation, said load pin being operable to measure the components of the force applied to the sheave along two mutually perpendicular axes.

4. The apparatus of claim 3, wherein one of said axes is parallel to said longitudinal axis.

5. The apparatus of claim 4, wherein said guide means is arranged to maintain said portion of the winch line parallel to said longitudinal axis.

6. The apparatus of claim 5, wherein said guide means comprises a guide sheave mounted for rotation on said tip portion and engaging said winch line.

7. The apparatus of claim 1, wherein said guide means comprises a guide sheave mounted for rotation on said tip portion and engaging said winch line.

8. A machine having an angularly variable aerial structure presenting a longitudinal axis and a tip portion, means for varying the angle of said longitudinal axis relative to a horizontal orientation, a sheave on said tip portion, a winch, and a winch line passing over the sheave and operated by the winch to raise and lower a load carried on the winch line, wherein the improvement comprises:

a dual axis load pin mounted on said tip portion and providing a substantially horizontal axis on which the sheave is mounted for rotation, said load pin being fixed and providing output signals indicative of the components of the force applied to said sheave by the load along two mutually perpendicular axes fixed relative to said longitudinal axis;

winch line guide means for maintaining a portion of the winch line adjacent to the sheave at a predetermined orientation relative to said longitudinal axis;

means for calculating from said force components the magnitude of the load; and means for visually displaying the magnitude of the load.

9. The machine of claim 8, wherein one of said mutually perpendicular axes is parallel to said longitudinal axis.

10. The machine of claim 9, wherein said guide means is arranged to maintain said portion of the winch line parallel to said longitudinal axis.

11. The machine of claim 8, wherein said machine is an overcenter machine in which said aerial structure can be moved past a vertical position with said winch line passing over the first mentioned sheave when the aerial structure is angled to one side of a vertical position and over a second sheave when the aerial structure is angled to the other side of a vertical position, and including:

a second dual axis load pin mounted on said tip portion and providing a substantially horizontal axis on which said second sheave is mounted for rotation, said second load pin being fixed and provid ng output signals indicative of said components of the force, said guide means maintaining a portion of the winch line adjacent to said second sheave at a predetermined orientation relative to said longitudinal axis when the winch line passes over said second sheave.

12. The machine of claim 11, wherein said guide means comprises a guide sheave mounted for rotation on said tip portion and engaging said winch line, said guide sheave being located and arranged to maintain said portion of the winch line in the same orientation relative to said longitudinal axis when the winch line passes over either the first mentioned sheave or said second sheave.

13. The machine of claim 12, wherein said guide sheave is arranged to maintain said portion of the winch line parallel to said longitudinal axis.

14. The machine of claim 8, wherein said guide means comprises a guide sheave mounted for rotation on said tip portion and engaging said winch line.

15. A machine having an angularly variable aerial structure which can be moved past a vertical orientation and which presents a longitudinal axis and a tip portion, means for varying the angle of said longitudinal axis relative to a horizontal orientation and for moving said aerial structure past a vertical orientation, first and second sheaves on said tip portion, a winch line arranged to pass over said first sheave when the aerial structure is angled to one side of a vertically oriented position and over said second sheave when the aerial structure is angled to the other side of a vertically oriented position, and a winch for winding in and paying out the winch line to raise and lower a load carried thereon, wherein the improvement comprises:

means for measuring, in two mutually perpendicular directions which are fixed relative to said longitudinal axis, the components of the force applied to said tip portion of the load when said line is passed over either sheave;

winch line guide means for maintaining a portion of the winch line at a known orientation to said longitudinal axis, said portion of the winch line being located adjacent to whichever of the sheaves the line passes over at the time;

means for calculating from said force components the magnitude of the load; and means for visually displaying the magnitude of the load.

16. The machine of claim 15, wherein said guide means is arranged to maintain said portion of the winch line parallel to said longitudinal axis.

17. The machine of claim 16, wherein one of said directions is parallel to said longitudinal axis.

18. The machine of claim 16, wherein said guide means comprises a guide sheave mounted for rotation on said tip portion and engaging said winch line.

19. The machine of claim 15, wherein said means for measuring comprises:

a first dual axis load pin on which said first sheave is mounted for rotation; and a second dual axis load pin on which said second sheave is mounted for rotation, each load pin being operable to measure the components of the force applied thereto in said two mutually perpendicular directions.

* * * * *

UNITED STATES PATENT AND TRADEMARK OFFICE

CERTIFICATE OF CORRECTION

PATENT NO. : 6,044,991
DATED : April 4, 2000
INVENTOR(S) : Frank D. Freudenthal
Edwin L. Vollmer It is certified that error appears in the above-identified patent and that said Letters Patent is hereby corrected as shown below:

replace [73] on the patent cover page, BIRMINGTON with

BIRMINGHAM

Signed and Sealed this

Tenth Day of April, 2001

*Attest:*

Nicholas P. Godici

NICHOLAS P. GODICI

*Attesting Officer*

*Acting Director of the United States Patent and Trademark Office*